US007743825B2

(12) United States Patent
O'Malley et al.

(10) Patent No.: US 7,743,825 B2
(45) **Date of Patent: *Jun. 29, 2010**

(54) PACKER SEALING ELEMENT WITH SHAPE MEMORY MATERIAL

(75) Inventors: Edward J. O'Malley, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 243 days.

This patent is subject to a terminal disclaimer.

(21) Appl. No.: 11/607,677

(22) Filed: Dec. 1, 2006

(65) Prior Publication Data

US 2007/0240877 A1 Oct. 18, 2007

Related U.S. Application Data

(63) Continuation-in-part of application No. 11/404,130, filed on Apr. 13, 2006.

(51) Int. Cl.
*E21B 33/128* (2006.01)

(52) U.S. Cl. ..... 166/179; 166/203

(58) Field of Classification Search ..... 166/387, 166/203, 179, 118, 138
See application file for complete search history.

(56) References Cited

U.S. PATENT DOCUMENTS 3,420,363 A 1/1969 Blickensderfer
4,424,865 A * 1/1984 Payton, Jr. ..... 166/302
4,441,721 A 4/1984 Harris et al.
4,515,213 A 5/1985 Rogen et al.
4,554,973 A 11/1985 Shonrock et al.
4,862,967 A * 9/1989 Harris ..... 166/387

(Continued)

FOREIGN PATENT DOCUMENTS

DE 4122811 A1 1/1993

(Continued)

OTHER PUBLICATIONS

Gall, Ken, et al., Carbon Fiber Reinforced Shape Memory Polymer Composites, Journal of Intelligent Material Systems and Structures, vol. II, Nov. 2000, 877-886.

(Continued)

*Primary Examiner*—David J Bagnell
*Assistant Examiner*—David Andrews
(74) *Attorney, Agent, or Firm*—Steve Rosenblatt

(57) ABSTRACT

A packer or bridge plug uses a sealing element made from a shape memory polymer (SMP). The packer element receives heat or other stimulus to soften the SMP while the element is compressed and retained. While so retained, the heat or other stimulus is removed to allow the SMP to get stiff so that it effectively seals a surrounding tubular. High expansion rates are possible as the softness of the material under thermal input allows it to be reshaped to the surrounding tubular or to the surrounding open hole from a smaller size during run in and to effectively retain a sealed configuration after getting stiff on reduction in its core temperature while longitudinally compressed. The SMP or equivalent material whose modulus is changeable can be covered on the outside, the inside or both with an elastic material that protects the SMP and enhances the seal in the wellbore and against the mandrel.

10 Claims, 3 Drawing Sheets

U.S. PATENT DOCUMENTS

| | | | | |
|---|---|---|---|---|
| 4,990,545 | A | 2/1991 | Hourai et al. | |
| 5,049,591 | A | 9/1991 | Hayashi et al. | |
| 5,145,935 | A | 9/1992 | Hayashi | |
| 5,941,313 | A | 8/1999 | Arizmendi | |
| 6,446,717 | B1 | 9/2002 | White et al. | |
| 6,583,194 | B2 | 6/2003 | Sendijarevic | |
| 6,598,672 | B2 | 7/2003 | Bell et al. | |
| 6,817,441 | B2 | 11/2004 | Murakami et al. | |
| 6,896,063 | B2 | 5/2005 | Chang et al. | |
| 7,234,533 | B2 | 6/2007 | Gambier | |
| 7,243,732 | B2 | 7/2007 | Richard | |
| 2002/0166672 | A1 | 11/2002 | White et al. | |
| 2003/0037921 | A1 | 2/2003 | Goodson, Jr. | |
| 2004/0194959 | A1 | 10/2004 | Chang et al. | |
| 2004/0194970 | A1 | 10/2004 | Eatwell et al. | |
| 2005/0067170 | A1 | 3/2005 | Richard | |
| 2005/0199401 | A1 | 9/2005 | Patel et al. | |
| 2006/0042801 | A1 | 3/2006 | Hackworth et al. | |
| 2006/0219400 | A1 * | 10/2006 | Xu et al. | 166/187 |
| 2007/0163777 | A1 | 7/2007 | Murray et al. | |
| 2007/0240877 | A1 | 10/2007 | O'Malley et al. | |

FOREIGN PATENT DOCUMENTS

| | | | |
|---|---|---|---|
| WO | 02099246 | A1 | 12/2002 |

OTHER PUBLICATIONS

Tey, S J, et al., Influence of long-term storage in cold hibernation on strain recovery and recovery stress of polyurethane shape memory polymer foam, Smart Materials and Structures, Institute of Physics Publishing, 2001, 321-325.

Liu, C., et al., Review of progress in shape-memory polymers, Journal of Materials Chemistry, The Royal Society of Chemistry, 2007, 1543-1558.

Coronado, Martin P., et al., Advanced Openhole Completions Utilizing a Simplified Zone Isolation System, SPE77438, Sep.-Oct. 2002, 1-11.

Song, G. Z., An Innovative Ultradeepwater Subsea Blowout Preventer (SSBOP) Control System Using Shape Memory Alloy Actuators, IADC/SPE 99041, Feb. 2006., 1-7.

Ma, Ning U., Design and Peformance Evaluation of an Ultradeepwater Subsea Blowout Preventer Control System Using Shape Memory Alloys Actuator, SPE 101080, Sep. 2006, 1-8.

* cited by examiner

PACKER SEALING ELEMENT WITH SHAPE MEMORY MATERIAL

PRIORITY INFORMATION

This application is a continuation-in-part of U.S. patent application Ser. No. 11/404,130, filed on Apr. 13, 2006.

FIELD OF THE INVENTION

The field of the invention is packers and bridge plugs for downhole use and more particularly those that require high expansion in order to set.

BACKGROUND OF THE INVENTION

Packers and bridge plugs are used downhole to isolate one part of a well from another part of the well. In some applications, such as delivery through tubing to be set in casing below the tubing, the packer or bridge plug must initially pass through a restriction in the tubing that is substantially smaller than the diameter of the casing where it is to be set. One such design of a high expansion bridge plug is U.S. Pat. No. 4,554,973 assigned to Schlumberger. As an example, this design can pass through 2.25 inch tubing and still be set in casing having an inside diameter of 6.184 inches. The sealing element is deformable by collapsing on itself. The drawback of such a design is that setting it requires a great deal of force and a long stroke.

Another design involves the use of an inflatable that is delivered in the collapsed state and is inflated after it is properly positioned. The drawback of such designs is that the inflatable can be damaged during run in. In that case it will not inflate or it will burst on inflation. Either way, no seal is established. Additionally, change in downhole temperatures can affect the inflated bladder to the point of raising its internal pressure to the point where it will rupture. On the other hand, a sharp reduction in temperature of the well fluids can cause a reduction in internal sealing pressure to the point of total loss of seal and release from the inside diameter of the wellbore.

Conventional packer designs that do not involve high expansion use a sleeve that is longitudinally compressed to increase its diameter until there is a seal. In large expansion situations, a large volume of solid sleeve is needed to seal an annular space between a mandrel that can be 1.75 inches and a surrounding tubular that can be 6.184 inches. The solution has typically been to use fairly long sleeves as the sealing elements. The problem with longitudinal compression of a sleeve with a large ratio of height to diameter is that such compression doesn't necessarily produce a linear response in the way of a diameter increase. The sleeve buckles or twists and can leave passages on its outer surface that are potential leak paths even it makes contact with the surrounding tubular.

Shape memory polymers (SMP) are known for their property of resuming a former shape if subjected to a given temperature transition. These materials were tested in a high expansion application where their shape was altered from an initial shape to reduce their diameter with the idea being that exposure to downhole temperatures would make them revert to their original shape and hopefully seal in a much larger surrounding pipe. As it turned out the resulting contact force from the memory property of such materials was too low to be useful as the material was too soft to get the needed sealing force after it changed shape.

U.S. Pat. No. 5,941,313 illustrates the use of a deformable material within a covering as a sealing element in a packer application.

The preferred embodiment of present invention seeks to address a high expansion packer or bridge plug application using SMP and takes advantage of their relative softness when reaching a transition temperature where the SMP wants to revert to a former shape. Taking advantage of the softness of such a material when subjected to temperatures above its transition temperature, the present invention takes advantage of that property to compress the material when soft to reduce the force required to set. The SMP is constrained while the temperature changes and as it gets stiffer while retaining its constrained shape so that it effectively seals.

Those skilled in the art will better appreciate the various aspects of the invention from the description of the preferred embodiment and the drawings that appear below and will recognize the full scope of the invention from the appended claims.

SUMMARY OF THE INVENTION

A packer or bridge plug uses a sealing element made from a shape memory polymer (SMP). The packer element receives heat or other stimulus to soften the SMP while the element is compressed and retained. While so retained, the heat or other stimulus is removed to allow the SMP to get stiff so that it effectively seals a surrounding tubular. High expansion rates are possible as the softness of the material under thermal input allows it to be reshaped to the surrounding tubular or to the surrounding open hole from a smaller size during run in and to effectively retain a sealed configuration after getting stiff on reduction in its core temperature while longitudinally compressed. The SMP or equivalent material whose modulus is changeable can be covered on the outside, the inside or both with an elastic material that protects the SMP and enhances the seal in the wellbore and against the mandrel.

DETAILED DESCRIPTION OF THE DRAWINGS

DETAILED DESCRIPTION OF THE PREFERRED EMBODIMENT

The packer or bridge plug 10 has a mandrel 12 and a sealing element 14 that is preferably slipped over the mandrel 12. Backup devices 16 and 18 are mounted over the mandrel 12 on either side of the element 14. One or both can be mounted to move along mandrel 12. They may be conical shapes or a petal design such as shown in U.S. Pat. No. 4,554,973 or other shapes to act as retainers for the element 14 and to act as transfer surfaces for applied compressive forces to element 14. They can be brought closer to each other to put the compressive loading on the element 14 through a variety of techniques including hydraulic pressure, setting down weight, gas generating tools or other equivalent devices to generate a longitudinal force.

Figure 1:
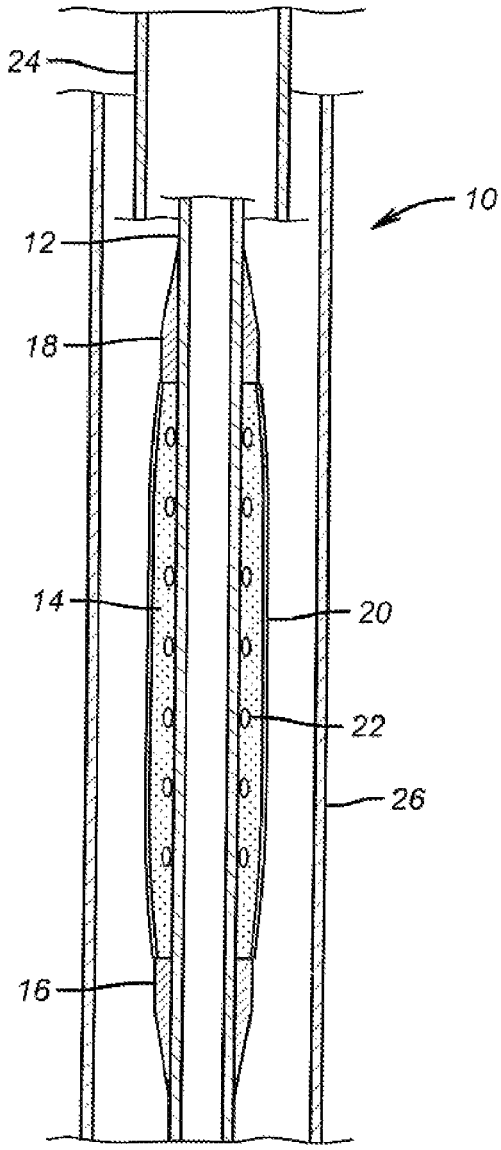
FIG. 1 is a section view in the run in position.

Preferably, the element 14 is made from an SMP or other materials that can get softer and harder depending on the temperature to which they are exposed. As shown in FIG. 1 an outer cover 20 can be provided to encase the element 14. Preferably the cover is thin and flexible enough to minimize resistance to shape change in the element 14 created by relative movement of the backup devices 16 and 18. Preferably, the cover 20 is flexible to move with while containing the element 14 when its shape is changed during setting. It also provides protection for the element 14 during run in.

FIG. 1 further generically shows a heat source 22 that can affect the temperature of the element 14. While shown embedded in the element 14, it can be on its outer surface in contact with the cover 20 or it can generically represent a heat source that reaches element 14 from the surrounding well fluid. The source 22 can be a heating coil, materials that are initially separated and then allowed to mix on setting to create heat or other devices that create heat when needed to soften the element 14 for setting.

Figure 2:
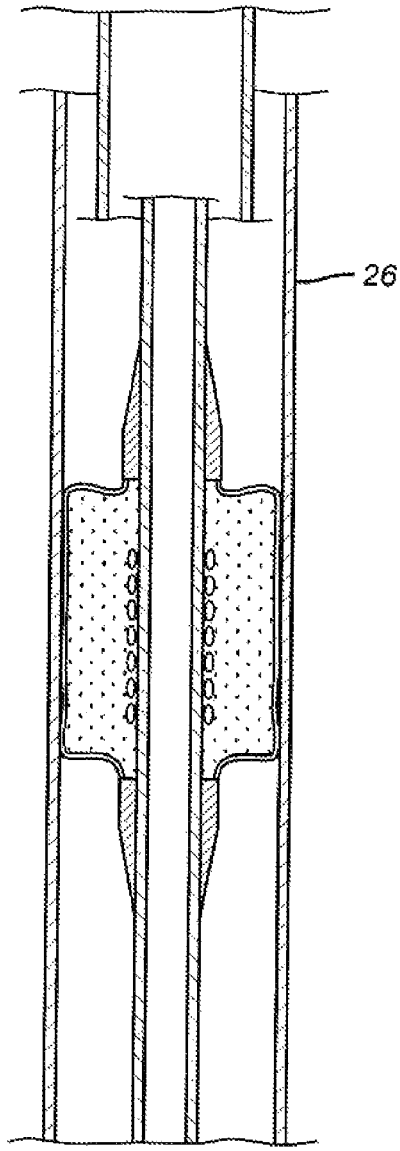
FIG. 2 is a section view in the set position.

In operation, the packer or plug is located in the well. It may be delivered through tubing 24 into a larger tubular 26. Heat is applied from source 22. The element, when made of the preferable SMP material responds to the heat input and gets softer while trying to revert to its former shape. At the same time as the heat is applied making the element 14 softer, the backup devices 16 and 18 move relatively to each other to put a longitudinal compressive force on element 14 that is now easier to reconfigure than when it was run in due to application of heat from source 22. While applying compressive force to the element 14, the source 22 is turned off which allows the SMP of element 14 to start getting harder while still being subject to a compressive force. The compressive force can be increased during the period of the element 14 getting stiffer to compensate for any thermal contraction of the element 14. Because the element 14 is softened up, the force to compress it into the sealing position of FIG. 2 is measurably reduced. Stiffness is considered in this application as the ability of the element to resist distorting force at a given degree of compression.

Alternative to adding heat through a heat source that is within the element 14, heat from the well fluid can be used to soften up element 14 if well conditions can be changed to stiffen up element 14 after it is set. For example if the onset of a flowing condition in the well will reduce the well fluid temperature, as is the case in injector wells, then the mere delivery of the packer 10 into the wellbore will soften up the element 14 for setting while allowing changed well conditions that reduce the fluid temperature adjacent the element 14 to allow it to get stiffer after it is set. While SMP materials are preferred, other materials that can be made softer for setting and then harder after setting are within the scope of the invention even if they are not SMP. Materials subject to energy inputs such as electrical to become softer for setting or that are initially soft and can be made harder after setting with such inputs are possibilities for element 14. Similarly materials whose state can be altered after they are set such as by virtue of a reaction by introduction of another material or a catalyst are within the scope of the invention. The invention contemplates use of an element that can be easily compressed to set and during or after the set start or fully increase in hardness so as to better hold the set. SMP represent a preferred embodiment of the invention. Multi-component materials that in the aggregate have one degree of stiffness that changes during or after compression to a greater stiffness are contemplated. One example is two component epoxies where the components mix as a result of expansion. In essence, the seal assembly undergoes a change in physical property during or after it is compressed apart from any increase in density.

The stimulus to make the change in physical property can come not only from an energy source within as shown in the Figures. The Figures are intended to be schematic. Energy sources external to the element 14 are contemplated that can come from well fluids or agents introduced into the well from the surface. The change of physical property can involve forms other than energy input such as introduction of a catalyst to drive a reaction or an ingredient to a reaction. Other stimuli may include: chemicals, (such as water-reactive shape memory polymers); sound waves, (which could act on absorptive material thereby generating heat); ultraviolet light; radiation, (alpha, beta, or gamma rays); vibration, (for temporary liquefaction of a granular substance); or magnetic or electric fields, (such as magnetorheological or electrorheoligical fluids).

The invention contemplates facilitating the compression of an element, which in the case of high expansion packers or bridge plugs becomes more significant due to the long stroke required and the uncertainties of element behavior under compression when the ratio of length to original diameter gets larger. In the preferred embodiment, using SMP with an internal energy source is but an embodiment of the invention.

A variety of materials whose modulus varies and stimuli that can create that change are described in U.S. Pat. No. 6,896,063 whose disclosure is fully incorporated herein as though fully set forth. It should be noted that this reference depends on storage of a potential energy force in the element and release of said force with a stimulus applied downhole so that the stored force acts in addition to any force created by a resumption of the material to its original shape. This adds a very limited sealing force to an already limited force gained from shape resumption. The present invention, with externally applied force as or after the softening has occurred from application of the stimulus, allows a far greater sealing force and hence the ability to tolerate greater differential pressures and still hold a seal.

Figure 3:
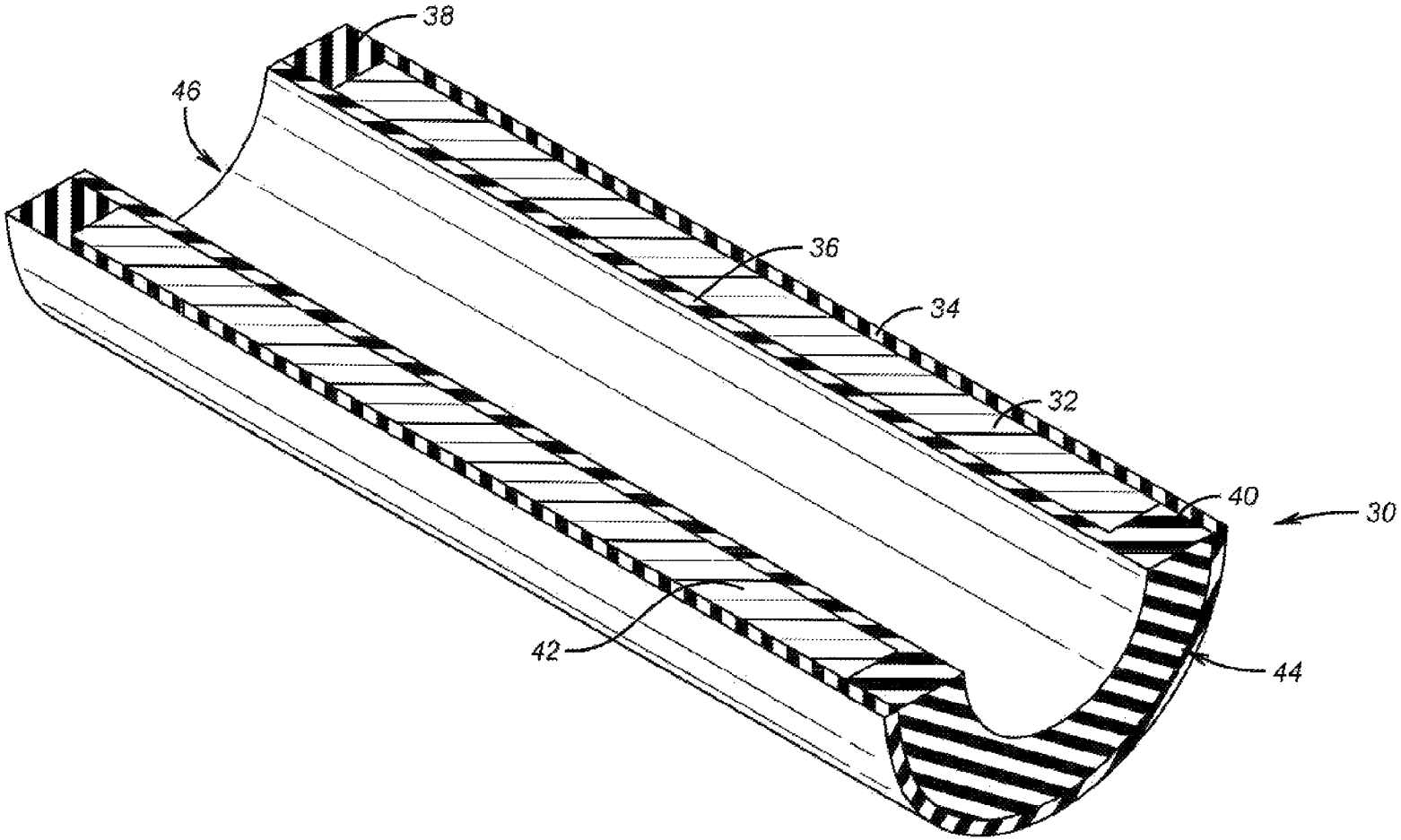
FIG. 3 is a perspective view showing a variable modulus material enveloped by an elastic material in the run in position.
Figure 4:
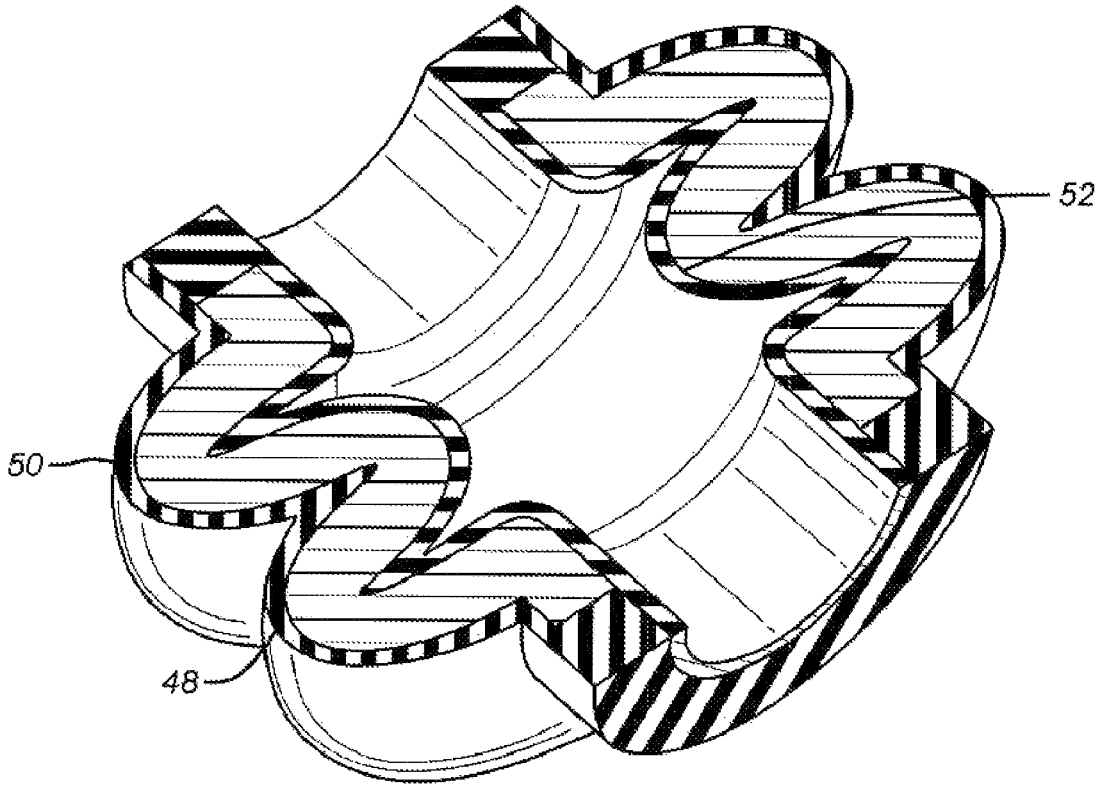
FIG. 4 is the view of FIG. 3 in the set position.

FIG. 3 shows a variation and omits the mandrel 12 for greater clarity. The element assembly 30 comprises an inner material 32 that has a selectively modified modulus such as a SMP, for example. Material 32 is preferably surrounded by a resilient material such as rubber that is preferably elastic, compatible with well conditions and impervious. The resilient material is preferably mounted outside 34, inside 36 and at opposed ends 38 and 40. The inside component 36 is preferably an interference fit and can be warmed to ease installation. It is desirable to have a net force applied against mandrel 12 from the assembly 30 after mounting. There are advantages to encasing the inner material 32. The material 32 can be somewhat porous particularly after its modulus is decreased with a stimulus shown schematically by arrow 42. The stimulus can be an energy source within or outside the material 32 or some other trigger that changes the modulus. As before, it is desirable to at least begin reducing the modulus of material 32 before applying an external compressive force shown schematically as arrows 44 and 46. The element assembly 30 can be in casing, as shown by its uniform collapse pattern in FIG. 4 or it can be in open hole. Inside casing or a tubular, despite the high percentage of radial expansion the growth pattern is more akin to the bellows shape shown in FIG. 4. Prior designs used in high expansion situations were uniform sleeves that were very long and low diameter to get through tubing and then be expanded into casing below the tubing. What happened to those cylinders, when compressed was a buckling and twisting that created leak paths against the casing. These sleeves were sometimes run with a second softer material on the exterior in the hope of getting the softer material to seal the external leak paths. The seal assembly 30 behaves differently. When the inner material 32 has its modulus reduced with the stimulus 42 while inside casing, it tends to buckle uniformly creating a series of ridges such as 48 and 50 that each have peaks that press firmly against the surrounding tubular for an external seal. Meanwhile the inner elastic component 36 which is preferably fluid impervious continues to make contact with the mandrel 12 (not shown in FIGS. 3 and 4) at valleys, such as 52, despite a length reduction that occurs from the external axial compression of 44 and 46. Inner elastic component helps eliminate leak paths along the mandrel 12 in the set position of FIG. 4. If the sealing assembly 30 is to be set in open hole the bellows shape shown in FIG. 4 is not necessarily the final shape. With the modulus of material 32 reduced by stimulus 42 and the applied external compression 44 and 46, the softened material 32 and the surrounding elastic cover 34 will assume the shape of the borehole wall. At the same time the elastic cover 36 that is closer to the mandrel 12 will more likely be pushed against the mandrel 12 as its length is reduced due to mechanical compression. Here again, it will stop leak paths from forming along the mandrel 12. Enveloping the material that has the changeable modulus or stiffness, removes concern about compatibility with well fluids and conditions and provides a greater assurance that leak paths will not form adjacent the mandrel whether in an open or cased hole application. The encasing material is preferably rubber but other materials with similar properties can also be used. While it is preferred to fully encase the inner material 32 other arrangements of less than all the encasing components can be used to garner some but not necessarily all of the benefits of full coverage. While a single assembly 30 is illustrated, multiple segments 30 that are identical or that vary can be used. For example, different materials 32 with variable modulus can be used or the level of coverage of the material(s) 32 can be used.

The above description is illustrative of the preferred embodiment and many modifications may be made by those skilled in the art without departing from the invention whose scope is to be determined from the literal and equivalent scope of the claims below.

We claim:

1. An apparatus for selectively obstructing a cased or open hole wellbore extending from a surface, comprising:

a mandrel having an outer surface;

a compressive assembly movably mounted to said outer surface of said mandrel on opposed ends of a sealing element assembly to retain said sealing element assembly while longitudinally compressing said sealing element assembly into sealing contact with the wellbore;

a selectively actuated heat source located adjacent said sealing element assembly;

said sealing element assembly further comprising a unitary sealing element made of a predetermined material mounted on said mandrel said element having a consistent stiffness therethrough and structurally capable of sealing a wellbore when compressed, said heat source actuated when said element is compressed to temporarily reduce the stiffness of said element and reduce the force required of said compressive assembly to bring said sealing element into initial wellbore sealing contact;

said heat source selectively deactivated with said sealing element in a sealing position in the wellbore to allow the stiffness of the sealing element to increase when in the sealing position to enhance the sealing contact in the wellbore.

2. The apparatus of claim 1, further comprising:

a resilient cover on said element that conforms to shape changes of said element;

said cover at least partially envelopes said element.

3. The apparatus of claim 2, wherein:

said cover is impervious to well fluids.

4. The apparatus of claim 3, wherein:

said cover is made of rubber.

5. The apparatus of claim 2, wherein:

said cover is disposed between said mandrel and the element.

6. The apparatus of claim 5, wherein:

said cover is an interference fit on said mandrel for run in.

7. The apparatus of claim 5, wherein:

said cover prevents leak paths along said mandrel after said element is longitudinally compressed.

8. The apparatus of claim 2, wherein:

said element and said cover take the shape of the wellbore when compressed.

9. The apparatus of claim 8, wherein:

said element and said cover deform into a plurality of ridges.

10. The apparatus of claim 9, wherein:

said cover fully envelops said element and is in contact with the wellbore and the mandrel to prevent leak paths internally and externally to said sealing element.

* * * * *